US008801453B1

(12) United States Patent
Scorzelli et al.

(10) Patent No.: US 8,801,453 B1
(45) Date of Patent: Aug. 12, 2014

(54) ROTARY CONNECTOR HAVING A HOUSING AND A LOCKING RING

(71) Applicant: Bourns, Inc., Riverside, CA (US)

(72) Inventors: Michael Scorzelli, Clarkston, MI (US); Craig Newmeyer, Howell, MI (US); Michael Holuk, Clinton Township, MI (US)

(73) Assignee: Bourns, Inc., Riverside, CA (US)

( * ) Notice: Subject to any disclaimer, the term of this patent is extended or adjusted under 35 U.S.C. 154(b) by 0 days.

(21) Appl. No.: 13/773,095

(22) Filed: Feb. 21, 2013

(51) Int. Cl.
*H01R 13/627* (2006.01)
*H01R 13/639* (2006.01)

(52) U.S. Cl.
CPC ..... *H01R 13/639* (2013.01)
USPC ..... 439/352

(58) Field of Classification Search
USPC ..... 439/13, 352, 752, 378, 320, 321
See application file for complete search history.

(56) References Cited

U.S. PATENT DOCUMENTS

| | | | | |
|---|---|---|---|---|
| 5,181,860 | A | 1/1993 | Honma et al. | |
| 6,203,349 | B1 * | 3/2001 | Nakazawa | 439/319 |
| 6,422,903 | B1 * | 7/2002 | Fekonja et al. | 439/752 |
| 6,626,699 | B1 | 9/2003 | Epe et al. | |
| 6,634,897 | B2 | 10/2003 | Cykon et al. | |
| 6,645,011 | B2 | 11/2003 | Schneider et al. | |
| 6,685,493 | B2 | 2/2004 | Birkenmaier et al. | |
| 6,749,454 | B2 | 6/2004 | Schmidt et al. | |
| 7,189,097 | B2 | 3/2007 | Benham | |
| 7,387,524 | B2 * | 6/2008 | Cheng | 439/352 |
| 7,455,543 | B2 * | 11/2008 | Natter et al. | 439/318 |
| 7,611,372 | B2 | 11/2009 | Shen et al. | |
| 2002/0197899 | A1 | 12/2002 | Cykon et al. | |
| 2011/0171849 | A1 | 7/2011 | Houir | |
| 2011/0225789 | A1 | 9/2011 | Darnell | |

FOREIGN PATENT DOCUMENTS

| | | | |
|---|---|---|---|
| DE | 43 06 806 | A1 | 9/1993 |
| DE | 44 29 780 | C1 | 3/1996 |
| DE | 19920481 | | 1/2001 |
| EP | 1 603 200 | A1 | 12/2005 |
| EP | 1 930 989 | A1 | 6/2008 |
| WO | 2006/031386 | A2 | 3/2006 |
| WO | 2009/062514 | A1 | 5/2009 |

OTHER PUBLICATIONS

Extended European Search Report received in European patent application No. 14154878.4, dated Jun. 2, 2014.

* cited by examiner

*Primary Examiner* — Chandrika Prasad
(74) *Attorney, Agent, or Firm* — Michael Best & Friedrich LLP

(57) ABSTRACT

A rotary connector assembly includes a connector housing sized to mate with a mating adapter and a lock ring. The connector housing includes at least one flexible tab. The lock ring is disposed over at least a portion of the connector housing. One of the connector housing and the lock ring includes a guide pin and the other includes a guide member disposed between the guide pin and the flexible tab. A rotation of the lock ring in a first direction flexes the tab radially inwards into a first position to secure the mating adapter in the connector housing, and a rotation of the lock ring in a second direction into a second position flexes the tab radially outwards to release the mating adapter from the connector housing. The guide pin translates relative to the guide member as the lock ring rotates between the first and second positions.

19 Claims, 6 Drawing Sheets

ROTARY CONNECTOR HAVING A HOUSING AND A LOCKING RING

BACKGROUND

The present invention relates to a connector for electrical components.

Electrical connectors are used for a variety of purposes, including connecting sensors to buses and networks. Modern vehicles include a myriad of sensors. Typically, each sensor includes a connector that permits the connection and disconnection of power and communication lines (typically in the form or multiple wires) between the sensor and a controller or a control system. In some instances, the communication and power lines form part of a vehicle bus or network (referred to as "vehicle bus" hereafter). Thus, it is possible to connect and replace sensors without the need to physically cut wires and splice them to reestablish a connection.

SUMMARY

During the assembly of a vehicle (for example, a passenger vehicle, commercial truck, or the like), sensors must be installed in the vehicle and connected to the vehicle bus. These operations are typically performed by technicians or assemblers (as opposed to robots or other automated mechanisms). At least some existing connectors require a technician to exert large amounts of assembly time and energy during vehicle assembly. Certain sensors include a mating adapter having one or more terminals. To facilitate vehicle assembly, it is desirable to have a connector that easily connects and disconnects to a mating adapter. It is also desirable to have a connector that provides a positive holding force throughout use.

In one embodiment, a rotary connector is configured to be connected to a mating adapter. The rotary connector comprises a connector housing being sized to mate with the mating adapter and a lock ring. The connector housing includes at least one flexible tab. The lock ring is disposed over at least a portion of the connector housing. One of the connector housing and the lock ring includes a guide pin and the other of the connector housing and the lock ring includes a guide member disposed between the guide pin and the flexible tab. A rotation of the lock ring in a first direction flexes the tab radially inwards into a first position to secure the mating adapter in the connector housing, and a rotation of the lock ring in a second direction into a second position flexes the tab radially outwards to release the mating adapter from the connector housing. The guide pin translates relative to the guide member as the lock ring rotates between the first and second positions.

In another embodiment, a rotary connector is configured to be connected to a mating adapter. The rotary connector comprises a connector housing being sized to mate with the mating adapter and a lock ring. The connector housing includes at least one guide pin and at least one flexible tab. The lock ring includes a guide channel configured to receive the at least one guide pin and permit translation of the at least one guide pin therein. A rotation of the lock ring in a first direction flexes the tab radially inwards into a first position to secure the mating adapter in the connector housing, and a rotation of the lock ring in a second direction into a second position flexes the tab radially outwards to release the mating adapter from the connector housing.

One advantage, among others, of embodiments of the invention is that the connector geometry allows assembly of the connector in only one position and likewise allows disassembly in only one position. In addition, the connector includes knurling and lobes that aid in grip during rotation. Further, the lock ring is designed so that radial interference is provided to prevent outward radial movement of the flexible tab after the lock ring is engaged. This provides support behind the flexible tabs so that the axial load needed to pull the connector apart is increased after assembly. This helps maintain a connection with the sensor when the vehicle is in use.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
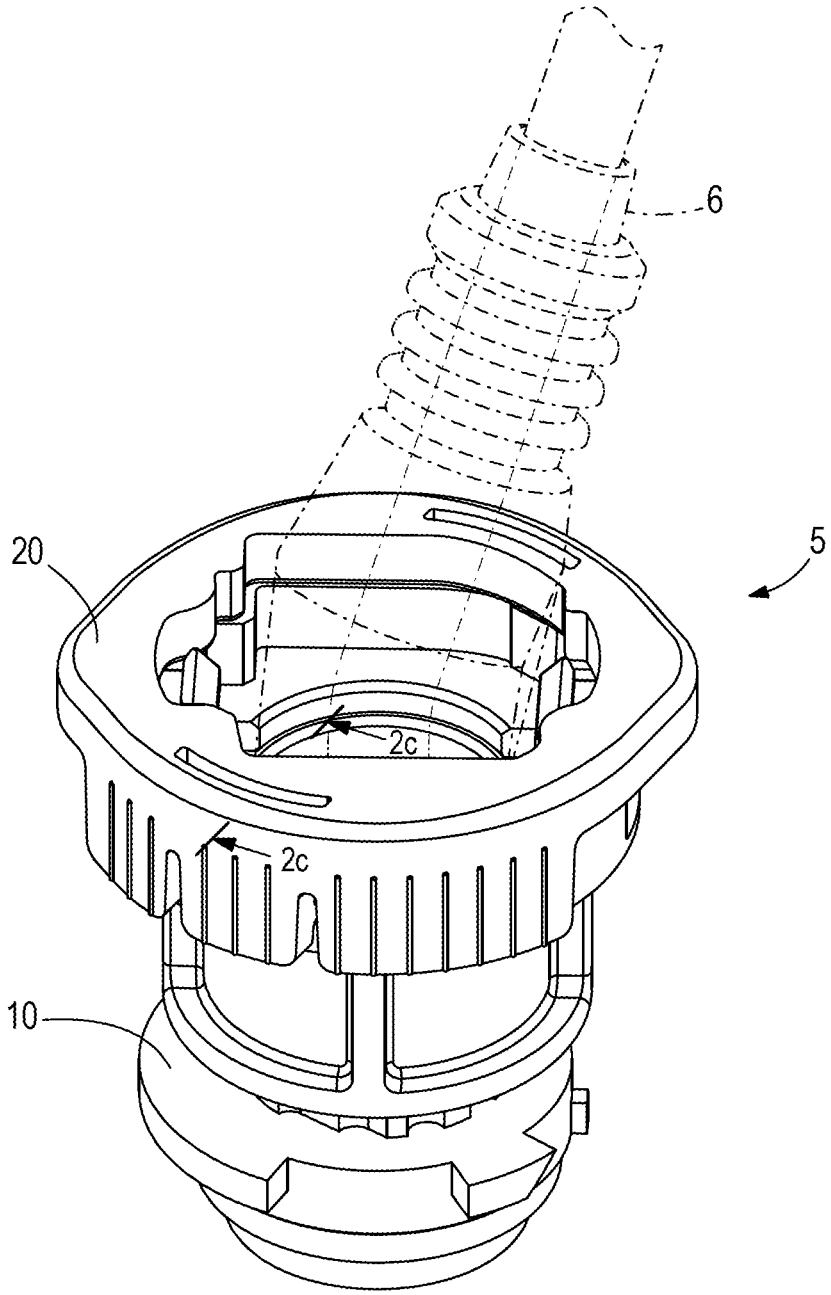
FIG. 1 is a perspective view of a mating adaptor assembled with a rotary locking ring and connector according to one embodiment of the invention.

FIG. 1 illustrates a rotary connector assembly 5 connected to a mating adapter 6. The mating adapter is connected to a sensor (not shown). The rotary connector assembly 5 includes a connector housing 10. The housing 10 is sized to mate with the mating adapter 6, and includes a lock ring 20. The connector housing 10 and lock ring 20 may be produced from an injection-molded plastic material, or may be made from other suitable materials.

Figure 2B:
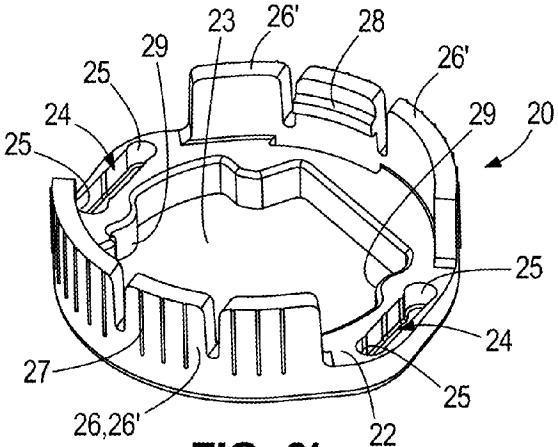
FIG. 2*b* is a perspective view of a lock ring of the rotary locking connector of FIG. 1.
Figure 2C:
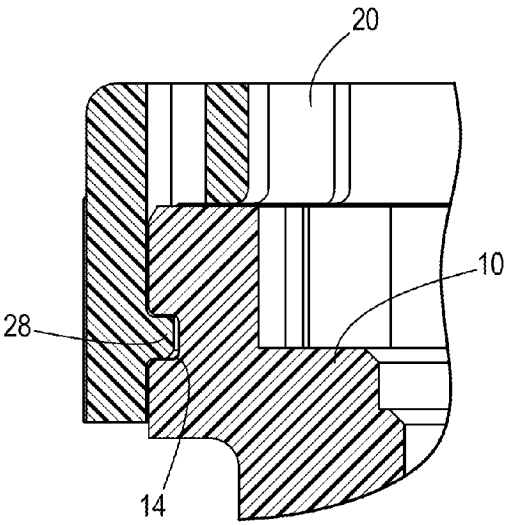
FIG. 2*c* is a section view of a portion of the rotary locking ring and connector of FIG. 1.
Figure 2A:
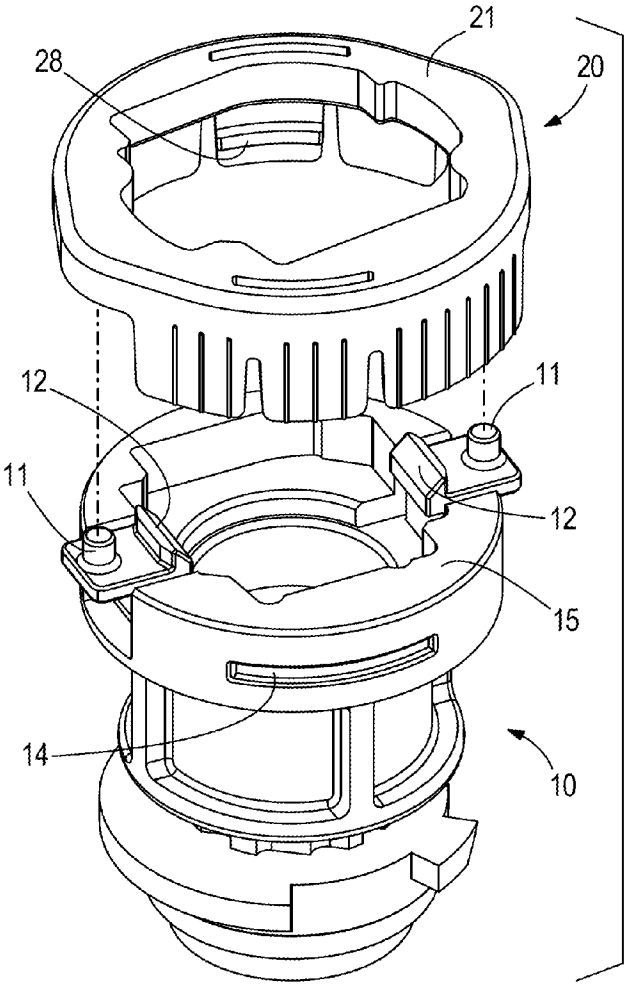
FIG. 2*a* is an exploded view of the rotary locking ring and connector of FIG. 1.
Figure 3A:
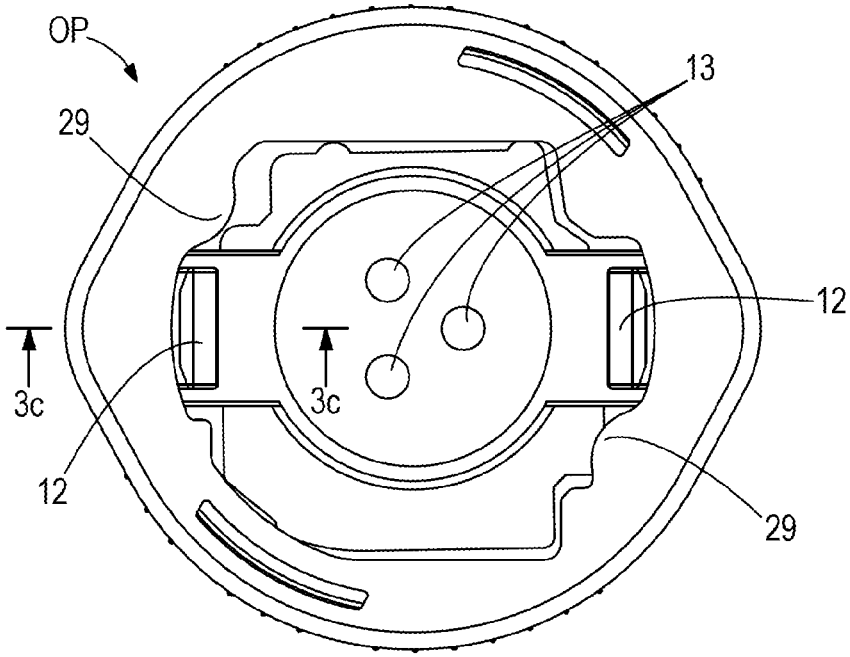
FIG. 3*a* is a top view of the rotary locking ring and connector of FIG. 1 in an open position.
Figure 3B:
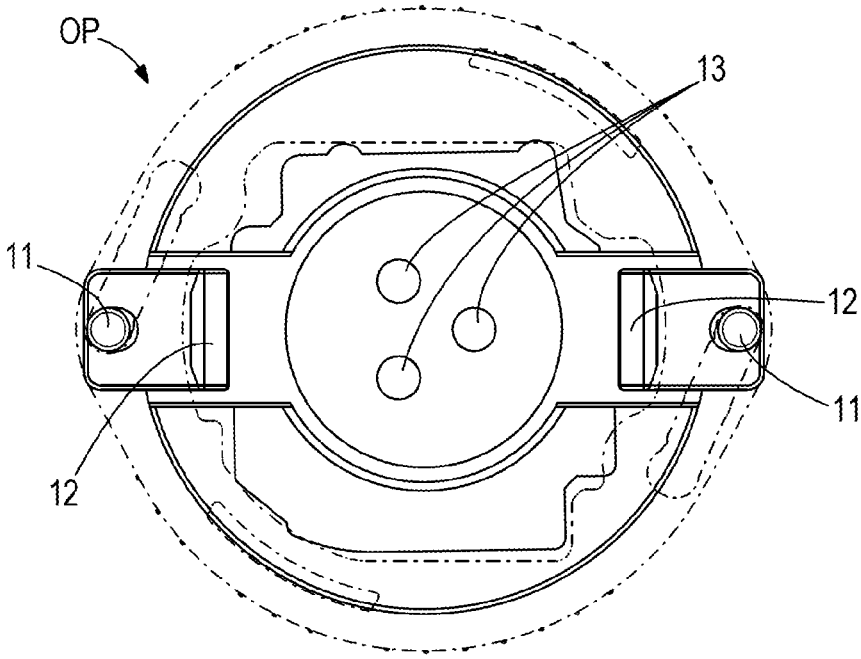
FIG. 3*b* is a top view of the rotary locking ring and connector of FIG. 1 in an open position.

As best viewed in FIG. 2*a*, the connector housing 10 has a generally hollow cylindrical shape and includes a pair of guide pins 11 and a pair of flexible lock tabs 12. The hollow space within the connector housing 10 allows the mating adapter 6 (FIG. 1) to be snugly fitted therein. The connector housing 10 may also include terminals 13 (FIGS. 3*a* and 3*b*) to provide an electrical connection between the mating adapter 6 (FIG. 1) and the connector housing 10 (and, ultimately between a sensor and other components, such as a vehicle bus and/or controller). Three terminals 13 are shown in FIGS. 3*a* and 3*b*, and the terminals 13 may be disposed at a lower portion of the interior of the connector housing 10

(FIG. 1). With continuing reference to FIG. 2*a*, a housing channel 14 is disposed circumferentially along the outer surface of the connector housing 10. The housing channel 14 secures the lock ring 20 (via a rib 28 (FIG. 2*b*) discussed below) on the connector housing 10 and provides mechanical end stops to prevent over-rotation of the lock ring 20.

The guide pins 11 are generally cylindrical in shape. Two guide pins 11 are shown in FIG. 2*a*, disposed across from each other on an upper surface 15 of the connector housing. In alternate embodiments, the guide pins 11 may be disposed on the lock ring 20. Additionally, the number of guide pins 11 is not limited to two. The connector housing 10 or the lock ring 20 may include a single guide pin, or may include more than two guide pins as needed for particular applications. The guide pins 11 translate relative to a guide member 24 (FIG. 2*b*) as the lock ring rotates (further described below).

Two tabs 12 are shown in FIG. 2*a*, each disposed radially inwards and in front of one of the guide pins 11. Thus, the number of tabs 12 is equal to the number of guide pins 11 in this embodiment. The tabs 12 flex radially outwardly to allow assembly of the mating adapter 6 to the connector housing 10. The tabs 12 interlock with the mating adapter 6 (FIG. 1) and provide axial strength to retain the connection when force is exerted on the mating adapter 6 (FIG. 1) or the connector housing 10.

As best viewed in FIGS. 2*a* and 2*b*, the lock ring 20 has a generally cylindrical shape. The lock ring 20 includes a recess 23 formed between its upper 21 and lower 22 surfaces. The lock ring 20 is sized to be placed over and around the connector housing 10, and is rotatable relative to the connector housing 10. The unique geometry of the lock ring 20 allows assembly of the mating adapter 6 (FIG. 1) in only one position of the lock ring 20, and likewise allows disassembly of the mating adapter 6 (FIG. 1) in only one position.

In the illustrated embodiment, the lock ring 20 includes a pair of guide members 24 that translate relative to the guide pins 11 disposed on the connector housing 10 as the lock ring 20 is rotated. Alternatively, the lock ring 20 could include the guide pins 11, while the connector housing 10 could include the guide members 24. The guide members 24 are disposed at least partially in between the guide pins 11 and the tabs 12. In some embodiments, the guide members 24 are guide pin channels 24 that receive the guide pins 11 and delimit translation of the guide pins 11 therein. As shown in FIG. 2*b*, the channels 24 are disposed across from each other on the lower surface 22 of the lock ring 20 corresponding to the positions of the guide pins 11. The guide pin members 24 may include detents 25 on each end thereof which provide positive feedback for assurance of an open or closed position, respectively.

The lock ring 20 also includes a shroud 26 disposed around a perimeter of the lower surface 22 and extending downward from the lower surface 22. As shown in FIG. 2*b*, the shroud 26 is disposed between the guide pin channels 24, and may include radially spaced apart gaps defining a plurality of shroud portions 26'. The shroud is designed to be gripped by an operator to enable rotation of the lock ring. To assist in the gripping of the lock ring 20, the shroud portions 26' may include indents or knurling 27 on an outer part of the shroud portions 26'. The inner part of the shroud portions 26' may include a ring retention rib 28 extending laterally across a shroud portion 26'. As shown in FIG. 2*c*, the ring retention rib 28 is sized and shaped to fit in the housing channel 14 of the connector housing 10.

With continued reference to FIG. 2*b*, the periphery of the recess 23 includes a pair of lock ring lobes 29 projecting into the recess 23, each lobe 29 corresponding to one of the tabs 12 in this embodiment. The lobes 29 provide the radial interference that prevents the tabs 12 from flexing radially outwards after the lock ring 20 is engaged with the mating adapter 6. More specifically, the lobes 29 provide support behind the tabs 12, so that the axial load needed to pull the mating adapter 6 (FIG. 1) apart from the rotary connector 5 (FIG. 1) s increased.

Figure 3C:
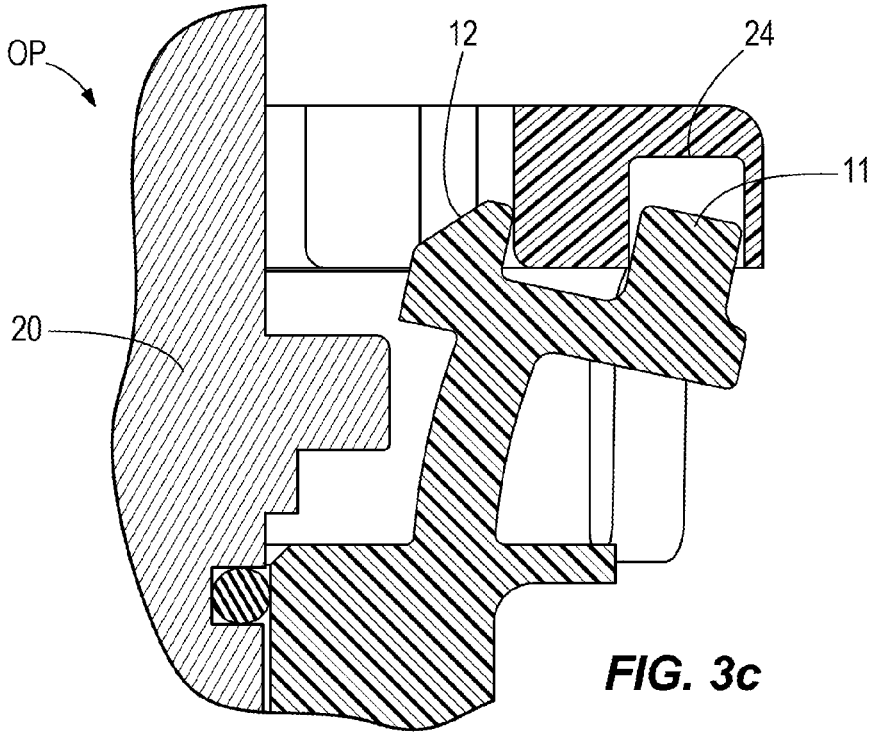
FIG. 3*c* is a section view of a portion of the rotary locking ring and connector of FIG. 1 in an open position.
Figure 3D:
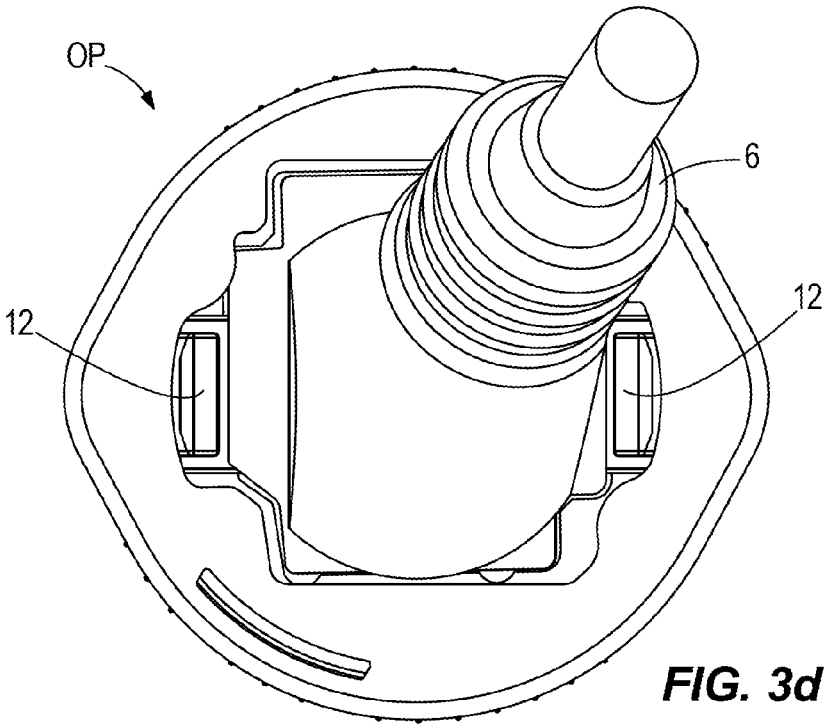
FIG. 3*d* is a top view of a mating adapter disposed in the rotary locking connector assembly of FIG. 1 in an open position.

To use the rotary locking connector 5 (FIG. 1), the lock ring 20 is first rotated in a first direction (for example, clockwise) into a clear or open position OP, as shown in FIGS. 3*a*-3*d*. In particular, as shown in FIGS. 3*b* and 3*c*, the guide pins 11 translate in the first direction relative to the respective guide members 24 (or within the respective channels 24) in the lock ring 20, with the detents 25 in the guide members 24 providing positive feedback for assurance of the open position OP. At the same time, as shown in FIG. 3*a*, the lock ring lobes 29 are rotated into a clear position relative to the tabs 12 to allow for loading of the mating adapter 6, shown in FIG. 3*d*. In the open position OP, the tabs 12 provide clearance for engagement and disengagement of the mating adapter 6.

Figure 4A:
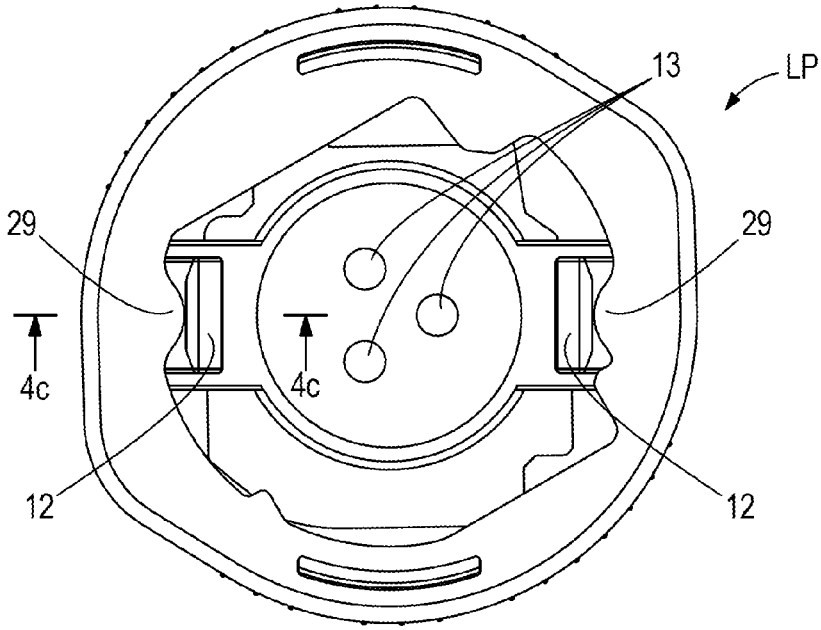
FIG. 4*a* is a top view of the rotary locking ring and connector of FIG. 1 in a locked position.
Figure 4B:
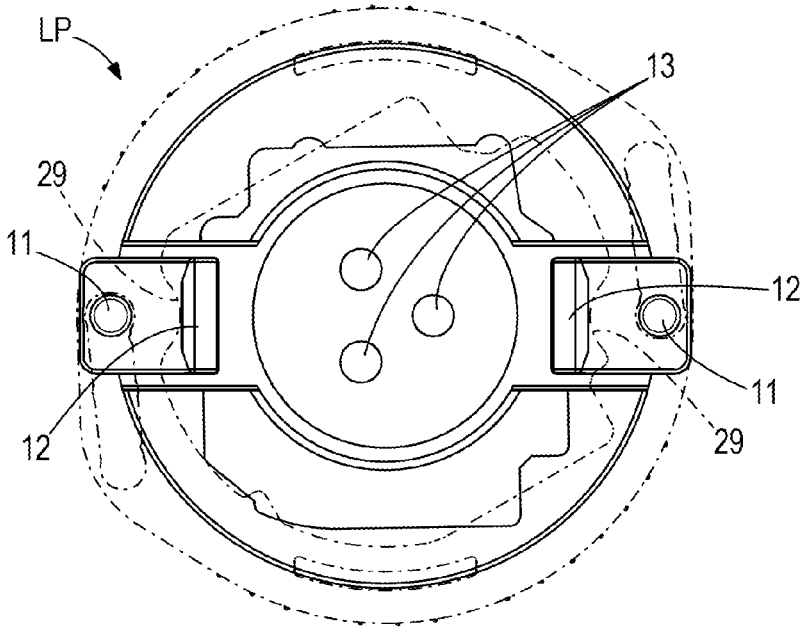
FIG. 4*b* is a top view of the rotary locking ring and connector of FIG. 1 in a locked position.
Figure 4C:
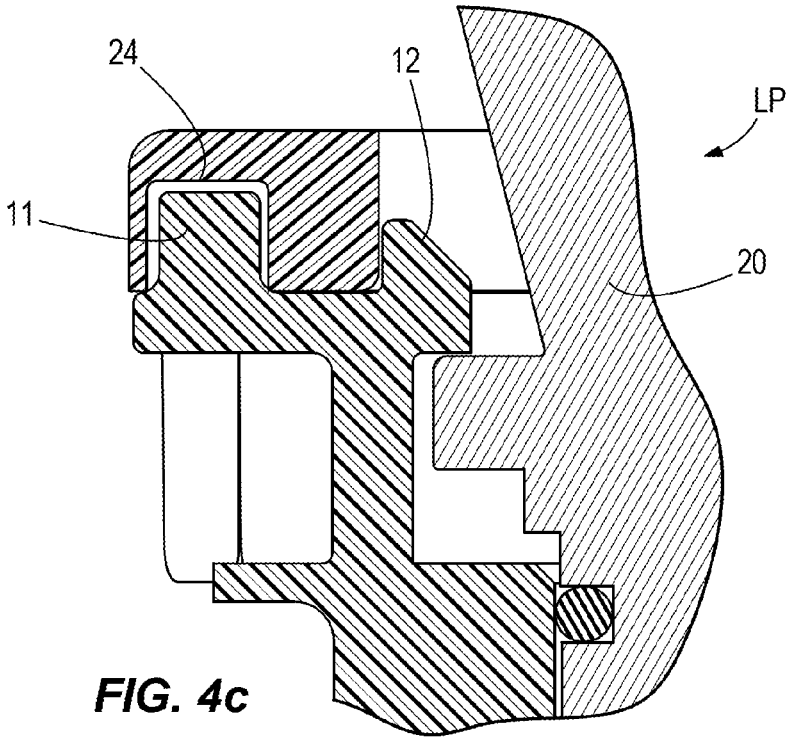
FIG. 4*c* is a section view of a portion of the rotary locking ring and connector of FIG. 1 in a locked position.
Figure 4D:
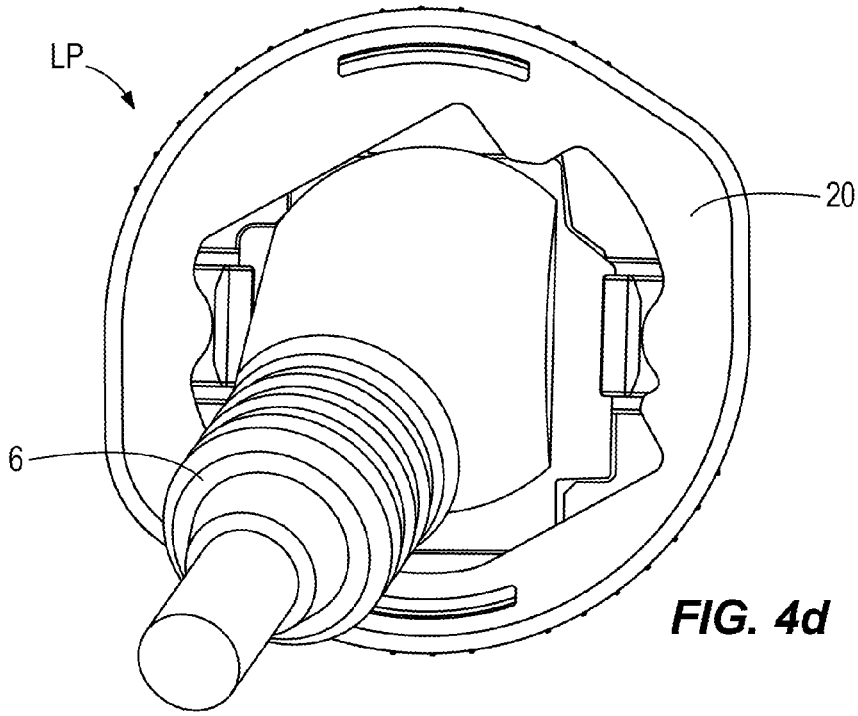
FIG. 4*d* is a top view of a mating adapter disposed in the rotary locking connector assembly of FIG. 1 in a locked position.

To secure the mating adapter 6 in the connector housing 10, the lock ring 20 is rotated in a second, opposite direction (for example, counter-clockwise) into a locked position LP, shown in FIGS. 4*a*-4*d*. In particular, as shown in FIGS. 4*b* and 4*c*, the guide pins 11 translate in a second, opposite direction relative to the respective guide members 24 in the lock ring 20, with the detents 25 (FIG. 2*b*) in the guide members 24 providing positive feedback for assurance of the locked position LP. At the same time, as shown in FIG. 4*a*, the lock ring lobes 29 are rotated to be positioned behind the tabs 12, thereby projecting the tabs 12 into the recess 23(FIG. 2*b*) of the lock ring 20 in to provide positive position and reinforcement for the tabs 12. In the locked position LP, as shown in FIGS. 4*c* and 4*d*, the tabs 12 provide axial force to the mating adapter 6 to secure the mating adapter 6 in the connector housing 10. To disconnect the mating connector 6 from the connector housing 10, the lock ring 20 must be rotated back to the open position OP.

While the text and drawings describe and illustrate certain embodiments of a rotary locking connector, one skilled in art should recognize that alternative configurations may be employed without deviating from the scope of the invention.

The invention claimed is:

1. A rotary connector configured to be connected to a mating adapter, the rotary connector comprising:

a connector housing being sized to mate with the mating adapter and including at least one flexible tab; and a lock ring disposed around at least a portion of the connector housing, wherein one of the connector housing and the lock ring includes a guide pin and the other of the connector housing and the lock ring includes a guide member disposed at least partially in between the at least one guide pin and the flexible tab, wherein a rotation of the lock ring in a first direction flexes the tab radially inwards into a first position to secure the mating adapter in the connector housing, and a rotation of the lock ring in a second direction into a second position flexes the tab radially outwards to release the mating adapter from the connector housing, and wherein the at least one guide pin translates relative to the guide member as the lock ring rotates between the first and second positions.

2. The rotary connector of claim 1, wherein the connector housing includes terminals for an electrical connection between the mating connector and the connector housing.

3. The rotary connector of claim 1, wherein the tab interlocks with the mating adapter in the first position.

4. The rotary connector of claim 1, wherein the rotation of the lock ring is delimited by the translation of the guide pin with respect to the guide member.

5. The rotary connector of claim 1, further comprising a lock ring lobe for each tab, the lock ring lobe providing radial interference that prevents outward movement of the tab in the first position.

6. The rotary connector of claim 5, wherein the lock ring lobe is disposed radially outside of the tab.

7. The rotary connector of claim 5, wherein the lock ring includes a recess and the lock ring lobe is a projection formed on a periphery of the recess and projecting into the recess.

8. The rotary connector of claim 1, wherein the lock ring includes at least one retention rib to hold the lock ring on the connector housing.

9. The rotary connector of claim 8, wherein the connector housing includes a housing channel for the retention rib.

10. The rotary connector of claim 1, wherein the lock ring includes a shroud configured to at least partially surround a periphery of the connector housing in an assembled state of the connector.

11. The rotary connector of claim 10, wherein the shroud includes a knurled portion.

12. The rotary connector of claim 10, wherein the shroud includes radially spaced gaps.

13. The rotary connector of claim 10, wherein the rotary connector includes at least two of the tabs and the shroud is disposed between the tabs.

14. The rotary connector of claim 1, wherein the tab projects into a recess of the lock ring in an assembled state.

15. The rotary connector of claim 1, wherein the guide member includes a first detent indicating the connector is in the first position and a second detent indicating the connector is in the second position.

16. The rotary connector of claim 1, wherein the rotary connector is made of a plastic material.

17. The rotary connector of claim 1, wherein the guide member is a guide channel that permits the translation of the at least one guide pin therein.

18. The rotary connector of claim 17, wherein the guide channel is formed in the lock ring.

19. A rotary connector configured to be connected to a mating adapter, the rotary connector comprising:

a lock ring, the lock ring including at least one guide pin;

a connector housing being sized to mate with the mating adapter and including, a guide channel configured to receive the at least one guide pin and permit translation of the at least one guide pin therein; and at least one flexible tab; and wherein a rotation of the lock ring in a first direction flexes the tab radially inwards into a first position to secure the mating adapter in the connector housing, and a rotation of the lock ring in a second direction into a second position flexes the tab radially outwards to release the mating adapter from the connector housing.

* * * * *